US005898018A

United States Patent [19]

Hirano et al.

[11] Patent Number: 5,898,018

[45] Date of Patent: Apr. 27, 1999

[54] COMPOSITE THERMAL TRANSFER SHEET AND THERMAL TRANSFER IMAGE-RECEIVING SHEET

[75] Inventors: Toshifusa Hirano; Masafumi Hayashi, both of Tokyo-to, Japan

[73] Assignee: Dai Nippon Printing Co., Ltd., Tokyo-to, Japan

[21] Appl. No.: 08/867,441

[22] Filed: Jun. 2, 1997

[30] Foreign Application Priority Data

Jun. 3, 1996 [JP] Japan ..... 8-160449

[51] Int. Cl.[6] ..... B41M 5/38

[52] U.S. Cl. ..... 503/227; 428/195; 428/206; 428/484; 428/488.1; 428/488.4; 428/913; 428/914

[58] Field of Search ..... 8/471; 428/195, 428/206, 484, 488.1, 488.4, 913, 914

[56] References Cited

U.S. PATENT DOCUMENTS

| | | | |
|---|---|---|---|
| 4,847,237 | 7/1989 | Vanderzanden | 503/227 |
| 5,264,279 | 11/1993 | Imamura et al. | 428/323 |
| 5,654,080 | 8/1997 | Hayashi et al. | 428/198 |

FOREIGN PATENT DOCUMENTS

| | | | |
|---|---|---|---|
| 0194106 | 9/1986 | European Pat. Off. | 503/227 |
| 0283025 | 9/1988 | European Pat. Off. | 503/227 |
| 0331525 | 9/1989 | European Pat. Off. | 503/227 |
| 2482008 | 11/1981 | France | 503/227 |

*Primary Examiner*—Bruce H. Hess
*Attorney, Agent, or Firm*—Ladas & Parry

[57] ABSTRACT

A composite thermal transfer sheet 100 comprising: a thermal transfer film 10 comprising a base film 11 and a heat-fusible ink layer 13 formed on the base film 11; and a thermal transfer image-receiving sheet 20 comprising a substrate 21 and a receptor layer 22 formed on the substrate 21, the receptor layer 22 comprising a thermoplastic resin, which has an adhesive property, and an inorganic and/or organic filler, the receptor layer 22 and the heat-fusible ink layer 13 being peelably bonded to each other by the adhesive property of the thermoplastic resin in the receptor layer 22, so that the thermal transfer film 10 and the thermal transfer image-receiving sheet 20 are peelably bonded to each other.

15 Claims, 1 Drawing Sheet

COMPOSITE THERMAL TRANSFER SHEET AND THERMAL TRANSFER IMAGE-RECEIVING SHEET

BACKGROUND OF THE INVENTION

1. Field of the Invention

The present invention relates to a so-called composite thermal transfer sheet constructed of a thermal transfer image-receiving sheet having a receptor layer on a substrate and a thermal transfer film having a heat-fusible ink layer on a base film, peelably bonded to each other, such that the receptor layer of the thermal transfer image-receiving sheet and the heat-fusible ink layer of the thermal transfer film are peelably attached to each other.

The present invention also relates to a thermal transfer image-receiving sheet having a receptor layer on a substrate to be used for the composite thermal transfer sheet.

2. Description of the Related Art

Recently, a thermal transfer medium of a heat-fusible transfer type is often used for output prints of a computer, a processor or the like.

As one example of such a thermal transfer medium of the heat-fusible transfer type, a thermal transfer film of the heat-fusible transfer type is constructed of: a base film composed of a plastic film having a thickness of about 3 to 20 [$\mu$ m] such as a polyester film or a cellophane film; and a heat-fusible ink layer which is coated on the base film and is composed of a mixture of vehicle (e.g. wax) and colorant such as pigment or dye.

When printing is affected on a thermal transfer image-receiving sheet using the aforementioned thermal transfer film, the thermal transfer film is supplied from a roll thereof, while a continuous or cut-sheet-like thermal transfer image-receiving sheet is also supplied, so that the former and the latter are superposed on each other on a platen. Then, in such a state, heat is applied to the thermal transfer film from the back side surface thereof by a thermal head, so that the heat-fusible ink layer of the thermal transfer film is melted and transferred to the thermal transfer image-receiving sheet. Therefore, a desired image is formed on the thermal transfer image-receiving sheet.

However, if the aforementioned thermal transfer film would be applied to a thermal printer used for printing on a heat-sensitive color-forming paper, a problem is posed as followings. Namely, the heat-sensitive color-forming paper develops coloring by itself (i.e. without the thermal transfer film). Therefore, the thermal printer used for printing on a heat-sensitive color-forming paper does not have any means for transporting the thermal transfer film. Thus, the thermal transfer film cannot be used in the aforementioned thermal printer.

In order to solve the aforementioned problem, the composite thermal transfer sheet is proposed. The composite thermal transfer sheet is constructed by peelably bonding a thermal transfer film and a thermal transfer image-receiving sheet. The thermal transfer film is constructed ofa base film and a heat-fusible ink layer formed thereon, and a thermal transfer image-receiving sheet is constructed of, for example, a plain paper, a synthetic paper, a coated paper and so on. Further, the thermal transfer film and the thermal transfer image-receiving sheet are peelably bonded through a temporary adhesive layer formed on the heat-fusible ink layer of the thermal transfer film. Furthermore, in the composite thermal transfer sheet, the thermal transfer film is peeled from the thermal transfer image-receiving sheet after printing, and thus an image is formed on the thermal transfer image-receiving sheet.

Here, the aforementioned composite thermal transfer sheet is produced by two kinds of methods as followings. Namely, in the first method, a heat-fusible ink layer is formed on the base film of the thermal transfer film, and then, the thermal transfer film is bonded to the thermal transfer image-receiving sheet by an adhesive component in the heat-fusible ink layer. On the other hand, in the second method, a temporary adhesive layer, which includes an adhesive component, is formed on the heat-fusible ink layer of the thermal transfer film, and then, the thermal transfer film is bonded to the thermal transfer image-receiving sheet though the temporary adhesive layer.

However, in the aforementioned composite thermal transfer sheet, since the thermal transfer film is bonded to the thermal transfer image-receiving sheet by the adhesive property of the thermal transfer film side, the adhesive property must be given to a layer to transfer an ink to the thermal transfer image-receiving sheet by heating (i.e. the heat-fusible ink layer). Therefore, there is a problem that an ink of the heat-fusible ink layer is easily transferred to the thermal transfer image-receiving sheet when the composite thermal transfer sheet is preserved for a long period, or preserved in a condition of high temperature. Therefore, a preservation environment and a preservation period are considerably restricted.

If the membrane strength of the heat-fusible ink layer is improved, or if the melting point thereof is made higher, the aforementioned problem may be solved. However, in this case, another problem is posed. Namely, in this case, the ability to transfer the ink of the heat-fusible ink layer to the thermal transfer image-receiving sheet is reduced. Therefore, the thermal transfer image-receiving sheet which can be used for the composite thermal transfer sheet may be restricted, and a printer having high energy with respect to printing is required.

On the other hand, as the usage of printed matter is broadened for various purposes, it is required that the composite thermal transfer sheets constructed of various kinds of the thermal transfer image-receiving sheets and various kinds of the thermal transfer films. Thus, it is necessary that an ink receptor layer is formed on a substrate of the thermal transfer image-receiving sheet, in order to improve the ability of ink reception and in order to improve the ability of paratripsis of printed matter. Further, as polychrome printed matter is developed, it is necessary that a layer to give coloration to the thermal transfer image-receiving sheet is formed on the composite thermal transfer film.

SUMMARY OF THE INVENTION

It is therefore an object of the present invention to provide a composite thermal transfer sheet and a thermal transfer image-receiving sheet, in which a thermal transfer film and the thermal transfer image-receiving sheet can be peelably bonded to each other by an adhesive property of the receptor layer of the thermal transfer image-receiving sheet, and in which the ability of ink reception and the ability of ink fixation can be improved, and in which printing energy can be reduced, namely, the printing sensitivity can be improved, and which prevents to occur background pollution by preservation for a long period or preservation in a condition of high temperature.

According to the present invention, the above mentioned object can be achieved by a composite thermal transfer sheet having a thermal transfer film constructed of a base film and a heat-fusible ink layer formed on the base film; and a thermal transfer image-receiving sheet constructed of a substrate and a receptor layer formed on the substrate, the receptor layer composed of a thermoplastic resin having an adhesive property and an inorganic and/or organic filler, the receptor layer and the heat-fusible ink layer being peelably bonded to each other by the adhesive property of the thermoplastic resin in the receptor layer, so that the thermal transfer film and the thermal transfer image-receiving sheet are peelably bonded to each other.

As mentioned above, since the adhesive property is given to the receptor layer of the thermal transfer image-receiving sheet, it is prevent that an ink of the heat-fusible ink layer of the thermal transfer film is easily transferred to the thermal transfer image-receiving sheet when the composite thermal transfer sheet is preserved for a long period, or it is preserved in a condition of high temperature. Thus, background pollution can be prevented.

Further, the filler of the receptor layer adjusts the adhesive property and prevents the heat energy supplied to the thermal transfer film from passing through the thermal transfer image-receiving sheet to the side of the substrate thereof. Thus, the printing sensitivity can be improved.

Furthermore, according the present invention, the adhesive property is given to the receptor layer of the thermal transfer image-receiving sheet, so that the thermal transfer film and thermal transfer image-receiving sheet are peelably bonded to each other by the adhesive property of the receptor layer. Therefore, the temporary adhesive layer is not need and thus the total number of the layer of the thermal transfer sheet is reduced. Hence, the printing energy is easily conducted to the receptor layer of the thermal transfer image-receiving sheet, and thus, the printing sensitivity can be improved.

Further, according to the present invention, a glass transition temperature of thermoplastic resin in the receptor layer is in the range of −50 [° C.] to 30 [° C.].

Thus, the suitable adhesive property for peelably bonding the thermal transfer film and thermal transfer image-receiving sheet is obtained in the receptor layer of the thermal transfer image-receiving sheet.

According to the present invention, the above mentioned object can be also achieved by a thermal transfer image-receiving sheet used for a composite thermal transfer sheet, having a substrate and a receptor layer formed on the substrate, and the receptor layer composed of a thermoplastic resin having an adhesive property and an inorganic and/or organic filler.

Thus, the thermal transfer image-receiving sheet can be peelably bonded to the thermal transfer film by the adhesive property of the receptor layer of the thermal transfer image-receiving sheet.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiments of the present invention will be now explained.

Figure 1:
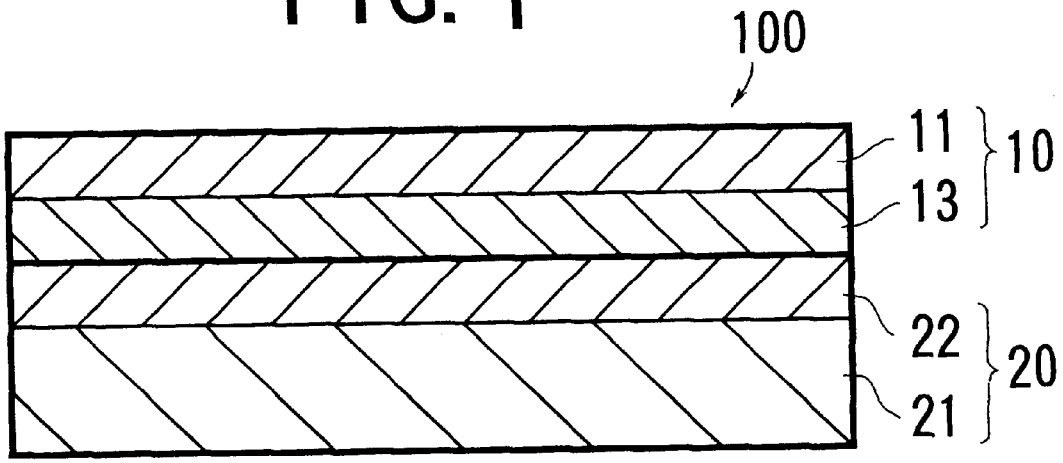
FIG. 1 is a schematic sectional view of an embodiment of the composite thermal transfer sheet according to the present invention.
Figure 2:
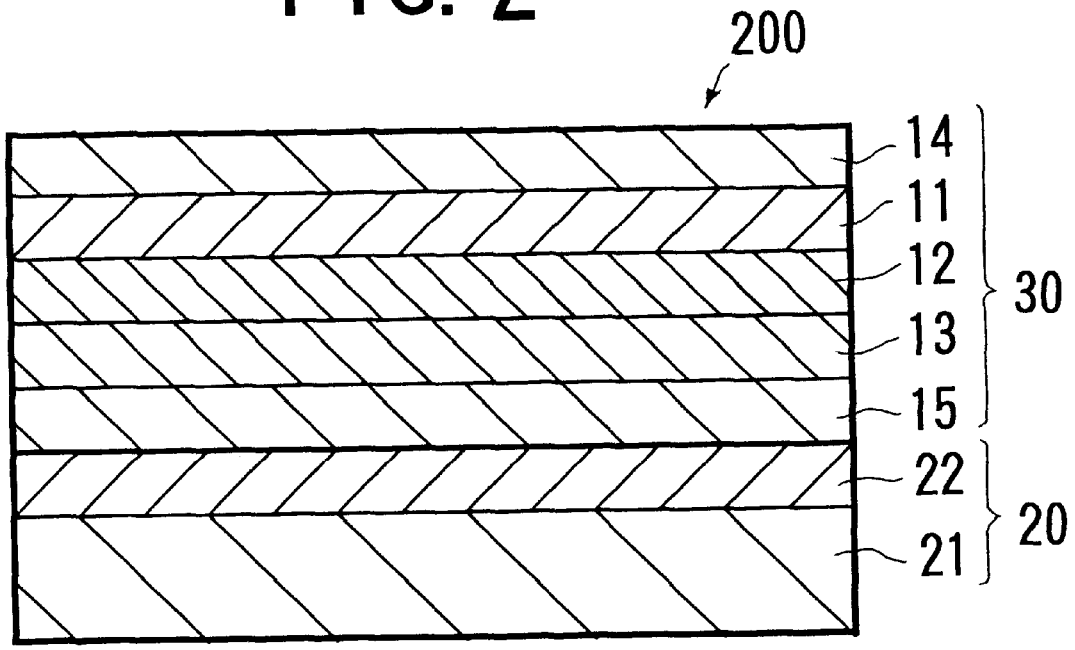
FIG. 2 is a schematic sectional view of another embodiment of the composite thermal transfer sheet according to the present invention.

Each of FIGS. 1 and 2 is a schematic sectional view of a preferable embodiment of a composite thermal transfer sheet according to the present invention.

In FIG. 1, a composite thermal transfer sheet 100 is one of the embodiments of present invention, and this is the most simple embodiment of the present invention. Namely, In FIG. 1, the composite thermal transfer sheet 100 is a so-called thermal transfer sheet of composite type, which is constructed by peelably bonding a thermal transfer film 10 and a thermal transfer image-receiving sheet 20 to each other. The composite thermal transfer sheet 100 is sold on the market as a product in a condition that the thermal transfer image-receiving sheet 20 and the thermal transfer sheet 10 are superposed and both are rolled.

Further, in FIG. 1, the composite thermal transfer film 10 is constructed of a base film 11 and a heat-fusible ink layer 13 formed thereon. On the other hand, the thermal transfer image-receiving sheet 20 is constructed of a substrate 21 and a receptor layer 22 formed thereon. Furthermore, the thermal transfer film 10 and thermal transfer image-receiving sheet 20 are peelably bonded to each other at the sides of the heat-fusible ink layer 13 and the receptor layer 22 respectively.

In FIG. 2, a composite thermal transfer sheet 200 is another embodiment of the present invention. In FIG. 2, the composite thermal transfer sheet 200 is constructed by peelably bonding a thermal transfer film 30 and the thermal transfer image-receiving sheet 20 to each other. The composite thermal transfer sheet 200, as well as the composite thermal transfer sheet 100, is sold on the market as a product in a condition that the thermal transfer image-receiving sheet 20 and the thermal transfer sheet 30 are superposed and both are rolled.

Further, in the thermal transfer film 30 shown in FIG. 2, a mat layer 12 is formed between the base film 11 and the heat-fusible ink layer 13, and further an anti-pollution layer 15 is formed on the heat-fusible ink layer 13. Furthermore, a back side layer 14 is formed on the back side surface of the base film 11.

The aforementioned elements of the composite thermal transfer sheets 100 and 200 will be explained in detail as followings.

Base Film

The base film 11 to be used in the present invention may be the same as that used in the conventional thermal transfer films as they are. However, the base film 11 is not restricted to such a conventional base film, but may also be another base film.

Preferred examples of the base film 11 may include: a plastic film composed of plastic such as polyester, polypropylene, cellophane, polycarbonate, cellulose acetate, polyethylene, polyvinyl chloride, polystyrene, nylon (trade mark), polyimide, polyvinylidene chloride, polyvinyl alcohol, fluorine contained resin, chlorinated rubber, ionomer etc; a paper such as a condenser paper and a paraffin paper; a non-woven fabric; and so on, and a mixture of these materials.

The thickness of the base film 11 may be appropriately changed corresponding to the material constituting it so as to provide suitable strength and thermal conductivity thereof, may be preferably about 2 [$\mu$ m] to 25 [$\mu$ m].

Heat-Fusible Ink Layer

The heat-fusible ink layer 13 formed on the aforementioned base film 11 contains colorant and binder as principal components, and further can contain additive selected from various additives as the occasion demand.

In case that the thermal transfer film 10 (or 30) is used for the purpose of monochrome printing such as black, carbon black may be preferred as the material included in the heat-fusible ink layer 13. However, the material of the heat-fusible ink layer 13 is not restricted to carbon black, but it may be another substance which has a suitable characteristic as a recording material among conventional organic or inorganic pigment. More concretely, the material of the heat-fusible ink layer 13 preferably has a suitable coloring concentration and the characteristic not to be discolored by light, heat, temperature and so on. Further, the material of the heat-fusible ink layer 13 may be another substance which is colorless in the state of non-heating but color is developed by heating. Furthermore, the material may be also the other substance whose color is developed by contacting a substance coated on the thermal transfer image-receiving sheet.

On the other hand, in case that the thermal transfer film 10 (or 30) is used for the purpose of multicolor printing, suitable colorant selected from various chromatic color pigment or dye such as yellow, magenta and cyan can be used as the material of the heat-fusible ink layer 13. In case that the receptor layer 22 is colored, the colorant whose color is different from that of the receptor layer 22 is selected.

The contents of the colorant is preferably about 1 [wt. %] to 70 [wt. %], based on the solid content of the heat-fusible ink layer 13.

In order to improve the thermal conductivity and the ability of heat-fusible transfer, a thermal conductivity substance may be incorporated into the heat-fusible ink. The thermal conductivity substance is, for example, aluminum, copper, tin oxide, molybdenum disulfide, carbonaceous material such as carbon black and so on.

The binder contained in the heat-fusible ink layer 13 is predominantly composed of the wax, and drying oil, resin, mineral oil, and derivatives of cellulose and rubber are preferably incorporated into the binder of the heat-fusible ink layer 13.

Examples of wax may include microcrystalline wax, ester wax, carnauba wax, paraffin wax and so on. In addition, specific examples of the wax may include various kinds thereof such as Fisher-Tropsch wax, various low-molecular weight polyethylene, Japan wax, beeswax, whale wax, insect wax, lanolin, shellac wax, candelilla wax, petrolactum, partially modified wax, fatty acid ester, fatty acid amide and so on. Further, one, two or more kinds of various conventional thermoplastic resin may be mixed within the binder.

Further, in order to achieve the purpose for improving the membrane strength of the heat-fusible ink layer 13, the purpose for adding the adhesive property thereto, the purpose for improving the cohesion thereof and so on, it is preferred to contain thermoplastic elastomer having rubber elasticity in the heat-fusible ink layer 13. Examples of thermoplastic elastomer having rubber elasticity may include: synthetic rubber such as ethylene-vinyl acetate copolymer, butadiene rubber, styrene-butadiene rubber, nitrile rubber, nitrile-butadiene rubber, high-styrene rubber, isoprene rubber and acrylic rubber; natural rubber; and so on.

It is especially preferred to adopt ethylene-vinyl acetate copolymer, styrene-butadiene rubber and/or acrylonitrile-butadiene rubber among aforementioned thermoplastic elastomer in order to improve the qualification of printing. In order to achieve the aforementioned purposes with respect to the heat-fusible ink layer 13, the contents of aforementioned thermoplastic elastomer is at least 1 [wt. %] to 50 [wt. %], based on the solid content of the heat-fusible ink layer 13. It will especially exhibit a suitable effect when the contents of the thermoplastic elastomer is 5 [wt. %] to 40 [wt. %]. If the contents of the thermoplastic elastomer is less than 1 [wt. %], the cohesion of the heat-fusible ink layer 13 is not enough, so that the printing quality is easily degraded. On the other hand, if the contents of the thermoplastic elastomer is more than 50 [wt. %], the membrane strength of the heat-fusible ink layer 13 becomes so large that the resolution of printing is degraded.

The tensile strength (JIS K6301) of the aforementioned thermoplastic elastomer having rubber elasticity is preferably not less than 1 [kg/c $m^2$ ] and not more than 100 [kg/c $m^2$]. If the tensile strength is less than 1 [kg/c $m^2$] or more than 100 [kg/c $m^2$], the printing quality is degraded.

The heat-fusible ink layer 13 is formed on the base film 11 by a method as explained below. Namely, the binder that predominantly contains the aforementioned wax is melted and mixed with the other necessary components, and thus, the melted liquid is produced. Then, this melted liquid is coated on the base film 11, and the heat-fusible ink layer 13 is formed by a general hot melt coating. On the other hand, the heat-fusible ink layer 13 is formed on the base film 11 by another method as explained below. Namely, the binder that predominantly contains the aforementioned wax is emulsificated or dispersed in aquosity medium, which may contain alcohol, to be emulsion. Further, colorant and the aquosity dispersoid of thermoplastic elastomer are mixed with this emulsion, and thus, the emulsion ink is prepared. Then, this emulsion ink is coated on the base film 11 by a forming method such as photogravure, screen process printing, the reverse or direct roll coating process using a wraparound gravure plate and so on, and then, the coated base film 11 is dried. Therefore, the heat-fusible ink layer 13 is formed. The thickness of the heat-fusible ink layer 13 formed by these methods is normally about 0.3 [$\mu$ m] to 10 [$\mu$ m].

Mat Layer

The mat layer 12 may be formed between the base film 11 and the heat-fusible ink layer 13 as shown in FIG. 2, because of the reason explained below.

Namely, as there is generally gloss on the surface of printing matter, it looks beautiful but it is sometimes difficult to read the letters printed on the printing matter. Therefore, mat printing is sometimes preferred. In this case, the mat layer 12 is formed between the base film 11 and the heat-fusible ink layer 13, as described in the application proposed by the applicant (Japanese Patent Application No. 58-208306). Namely, inorganic pigment such as silica, calcium carbonate and carbon black is dispersed in a desired solvent, and thus, the liquid is produced. Then, the liquid is coated on the base film 11 as the binder, and it is dried. Therefore, the mat layer 12 is formed.

The thickness of the mat layer 12 is preferably about 0.1 [$\mu$ m] to 10 [$\mu$ m]. If the thickness of the mat layer 12 is less than 0.1 [$\mu$ m], the ability of the mat layer is not enough, i.e. mat printing is not sufficient. If the thickness of the mat layer 12 is more than 10 [$\mu$ m], the high energy of printing is needed.

The mat layer 12 is formed by the method selected from the photogravure process, the gravure reverse roll coating process, the roll coat process and so on.

Anti-pollution layer

The anti-pollution layer 15, which is equal to or more than one layer, may be formed on the heat-fusible layer 13 as shown in FIG. 2. The anti-pollution layer 15 is disposed on the surface of the thermal transfer film 10 (or 30), so that the anti-pollution layer 15 contacts the receptor layer 22 when the thermal transfer film 10 (or 30) is peelably bonded to the thermal transfer image-receiving sheet 20. Further, it prevents so-called background pollution, which is occurred by the cause that the ink of the heat-fusible ink layer 13 is removed and adhered onto the thermal transfer image-receiving sheet 20, when the thermal transfer film 10 (or 30) is peeled off from the thermal transfer image-receiving sheet 20 after printing is carried out.

The anti-pollution layer 15 consists of transparent components. Namely, the anti-pollution layer 15 does not contain any colorant, and predominantly contains wax as one of the transparent components. Therefore, if the anti-pollution layer 15 is removed and adhered onto the thermal transfer image-receiving sheet 20 when the thermal transfer film 10 (or 30) is peeled from the thermal transfer image-receiving sheet 20, background pollution is not occurred because the anti-pollution layer 15 does not contain any colorant as mentioned above.

In order to prevent background pollution by the anti-pollution layer 15, the melting point of the wax used for the anti-pollution layer 15 is preferably higher than that of the heat-fusible ink layer 13.

Example of the wax to be used for the anti-pollution layer 15 may include microcrystalline wax, carnauba wax, paraffin wax or so on. In addition, specific examples of the wax may include various kinds thereof such as Fisher-Tropsch wax, various low-molecular weight polyethylene, Japan wax, beeswax, whalewax, insect wax, lanolin, shellac wax, candelilla wax, petrolactum, partially modified wax, fatty acid ester, fatty acid amide and so on. Especially, among the aforementioned wax, the wax to be used for the anti-pollution layer 15 preferably has the melting point of 60 [° C.] to 100 [° C.]. If the melting point of the wax is less than 60 [° C.], the preservability is degraded. If the melting point of the wax is more than 100 [° C.], the sensitivity of printing is not enough.

The anti-pollution layer 15 is formed by coating the coating liquid for formation thereof, and by using a method such as a hot melt coating process, a hot lacquer coating process, a gravure direct coating process, a gravure reverse coating, a knife coating process, an air coating process, a roll coating process and so on.

The thickness of the anti-pollution layer 15 is 0.05 [$\mu$ m] to 5 [$\mu$ m] in a dry condition. If the thickness in the dry condition is less than 0.05 [$\mu$ m ], it is not enough to obtain the effect of the preventing background pollution. If the thickness in the dry condition is more 5 [$\mu$ m], the sensitivity of printing is not enough.

Back Side Layer

As shown in FIG. 2, the back side layer 14 may be formed on the other side of the base film 11, i.e., the opposite surface of that on which the anti-pollution layer 15 is formed, in order to prevent the adhesion of a thermal head of a printer and to improve the ability of slide.

The back side layer 14 is formed by using the binder including slide agent, surface active surfactant (or surfactant), inorganic particles, organic particles and so on.

Examples of the binder to be used for the back side layer 14 may include: cellulose type resin such as ethylene cellulose, hydroxy ethyl cellulose, hydroxy propyl cellulose, methyl cellulose, cellulose acetate, butyric cellulose acetate and pyroxyline; vinyl type resin such as polyvinyl alcohol, polyvinyl acetate, polyvinyl butyral, polyvinyl acetal, polyvinyl pyrrolidone, acrylic resin, polyacrylamide and acrylonitrile-styrene copolymer; polyester resin, polyurethane resin; silicon denaturation or fluorine denaturation urethane resin; melanin resin; urea resin; and so on. Among these, the resin having a plurality of reactivity groups such as hydroxyl groups is selected, and the selected resin is used with the bridging (or cross linking) agent such as polyisocyanide. In this manner, it is preferred that the bridging resin is used for the back side layer 14.

The back side layer 14 is formed by the method explained below. Namely, the binder including slide agent, surface active surfactant, inorganic particles, organic particles, pigment and so on, is melted and disperse in the desired solvent, and thus, the coating liquid is produced. Then, this coating liquid is coated on the base film 11 by a general coating method such as a gravure coater, a roll coater, a wire bar, and it is dried. Therefore, the back side layer 14 is formed.

The thickness of the back side layer 14 is normally about 0.01 [$\mu$ m] to 10 [$\mu$ m].

Next, the thermal transfer image-receiving sheet 20, which is peelably bonded to the thermal transfer film 10 (or 30), as shown in FIGS. 1 and 2, will be explained.

Substrate

The material of the substrate 21 is not especially restricted. Preferable examples of the substrate 21 may include: a synthetic paper of polyolefine type and polystyrene type; a paper such as a wood free paper, an art paper, a coated paper, a cast-coated paper, a wall-paper, a lining paper (or backing paper), a synthetic resin or emulsion impregnation paper, a synthetic rubber latex impregnation paper, a synthetic resin internally-added paper, and a board; and a transparent or opaque plastic material such as polyester, polyvinyl chloride, polyvinylidene chloride, polyurethane, polyvinyl alcohol, polypropylene, polyethylene, polystyrene, ethylene-vinyl acetate copolymer, ethylene-ethyl acrylate copolymer, ethylene-acrylic acid copolymer, methyl pentene polymer, polyimide, polyamide, fluororesin and so no. Further, a white opaque film or a foamed sheet composed of the material, which white pigment and filler are incorporated into the aforementioned plastic material, can be used for the substrate 21.

Further, the transparent plastic film to be used for an OHP (Over Head Projector) may be used for the substrate 21 of the thermal transfer image-receiving sheet 20.

Furthermore, a layered product, which is formed of the combination of the aforementioned plastic materials, may be used for the substrate 21. In such a case, the combination of a cellulosic fiber paper and a synthetic paper or the combination of a cellulosic fiber paper and a plastic film is representative.

The thickness of the substrate 21 is changed in correspondence with the selected material and the production method, but it is normally 25 [$\mu$ m] to 500 [$\mu$ m], and preferably, 50 [$\mu$ m] to 150 [$\mu$ m].

Receptor Layer

The receptor layer 22 is formed on the aforementioned substrate 21, as shown in FIGS. 1 and 2. The receptor layer 22 performs to receive the ink transferred from the aforementioned thermal transfer film 10 (or 30). The receptor layer 22 is predominantly composed of thermoplastic resin having a glass transition temperature Tg of −50 [° C.] to 30 [° C.] and inorganic and/or organic filler.

Examples of the thermoplastic resin to be used for the receptor layer 22 may include copolymer of ethylene series, copolymer of styrene series, acrylic resin, vinyl acetate resin, vinyl chloride resin, polyester resin, polyurethane resin, petroleum resin, synthetic rubber, natural rubber and so no. Further, in order to improve the membrane strength of the receptor layer 22 and to improve the preservability in a condition that the thermal transfer film 10 (or 30) and the thermal transfer image-receiving sheet 20 are peelably bonded, the material to be used for the receptor layer 22 is preferably the thermoplastic resin whose molecular weight is as high as possible. Namely, the material of the receptor layer 22 is preferably selected from a kind of the thermoplastic elastomer, for example, synthetic rubber such as butadiene rubber, styrene-butadiene rubber, nitrile rubber, nitrile-butadiene rubber, high-styrene rubber, isoprene rubber and acrylic rubber; natural rubber; and so on.

Further, the material to be used for the receptor layer 22 is restricted to the thermoplastic resin having a glass transition temperature Tg of −50 [° C.] to 30 [° C.]. If Tg is more than 30 [° C.], the ability of adhesive of the receptor layer 22 is degraded, and it is difficult to bond the thermal transfer image-receiving sheet 20 and the thermal transfer film 10 (or 30) to each other, and further, the membrane strength is also degraded.

On the other hand, If Tg is less than −50 [° C.], the receptor layer 22 is sticky too much, and the preservability is degraded.

The thermoplastic resin having the aforementioned property performs as the adhesive component in the receptor layer 22, so that the thermal transfer film 10 (or 30) and the thermal transfer image-receiving sheet 20 are peelably bonded to each other by the receptor layer 22.

The filler to be used for the receptor layer 22 performs to adjust the adhesive of the receptor layer 22 and to prevent the heat energy supplied to the thermal transfer film 10 (or 30) from passing through the thermal transfer image-receiving sheet to the side of the substrate 21. Namely, the filler performs the thermal insulation effect, so that the effect of the filler is important in view of preservabilty and transferability.

The material of the filler is suitably selected among organic and/or inorganic particles, and it is not restricted. However, it is not preferred to use the particles whose diameter is more than the thickness of the receptor layer 22 because the printing concentration is degraded.

Examples of the filler may include: inorganic particles such as talc, clay, kaoline, calcium carbonate, magnesium carbonate, magnesium hydroxide, precipitated barium sulfate, hydrotalcite, silica and carbonate; and organic particles such as various kinds of resin of the ethylene type, styrene type, nylon type and acrylic type (modacrylic), and melanin resin. Further, a glass transition temperature Tg of the filler is preferably more than 50 [° C.], in order to obtain the suitable adhesive by mixing the filler with the aforementioned thermoplastic resin used for the receptor layer 22.

Furthermore, organic and/or inorganic coloring pigment may be used as the filler, as the occasion demand. Examples of the coloring pigment may include: yellow hue such as fast yellow, disazo yellow, permanent yellow, azo yellow of condensation type, monoazo yellow of acetonitrile type and isoindolenone yellow; orange hue such as disazo orange and vulcan orenge; red hue such as permanent carmine, brilliant fast scarlet, pyrazolone red, watchung red, lithol red, lake red, brilliant carmine, iron oxide red, quinacridone magenta, red of condensation type, naphtohol AS red and isoindolenone red; violet hue such as methyl violet lake, quinacridone violet, dioxazine violet and insoluble azo violet; blu hue such as phthalocyanine blue, fast sky blue, alkali blue toner, iron blue and ultramarine blue; green hue such as phthalocyanine green. The combination of these pigment may be used for the receptor layer 22.

Further, the surface treatment may be applied to the aforementioned coloring pigment to be used for the receptor layer 22, in order to improve the stability of dispersion in the receptor layer coating liquid.

The particle diameter of the filler may be in the range of 0.01 [$\mu$ m] to 10 [$\mu$ m], preferably in the range of 0.5 [$\mu$ m] to 3 [$\mu$ m].

The mixing ratio of the thermoplastic resin and the filler is preferably in the range of 1 : (0.5 to 10). If the contents of the filler is small and thus its ratio is out of the aforementioned preferable range, the printing sensitivity and the preservability are degraded. If the contents of the filler is large and thus its ratio is out of the aforementioned preferable range, the membrane strength and the fixation of the printing are degraded.

Other than the thermoplastic resin and the filler, various wax may be further incorporated into the receptor layer 22, in order to adjust the adhesive of the receptor layer 22 and the gloss of the surface of the receptor layer 22. In such a case, the wax may not be more than 30 [wt. %], based on the solid content of the whole receptor layer 22. If the wax is more than 30 [wt. %], the receptor layer 22 is easily melted and the melting and transferring efficiency of the heat-fusible ink layer 13 is degraded.

The receptor layer 22, in the dry condition, has the thickness of about 0.5 [$\mu$ m] to 30 [$\mu$ m]. If the thickness of the receptor layer 22 is too thin, the fixation of the heat-fusible ink is degraded and the printing sensitivity is also degraded. If the thickness of the receptor layer 22 is too thick, the membrane strength of the receptor layer 22 is weak and it becomes easy that the receptor layer 22 is removed and adhered onto the thermal transfer film 10 (or 30).

The receptor layer 22 is formed by the method explained below. Namely, the thermoplastic resin having a glass transition temperature Tg of −50 [° C.] to 30 [° C.] and the organic and/or inorganic filler is melted and dispersed in the desired solvent, and thus the coating liquid is produced. Then, this coating liquid is coated on the substrate 21 by a forming method such as photogravure, screen process printing, the reverse or direct roll coating process used for a wraparound gravure plate and the like, and it is dried. In this manner, the receptor layer 22 is formed on the substrate 21.

Further, in order to improve the adhesive of the receptor layer 22 and substrate 21, the receptor layer 22 may be formed on the substrate 21 through the primer layer, i.e., the primer layer may be formed between the receptor layer 22 and the substrate 21. Examples of the primer layer may include acrylic resin, nylon resin, vinyl chloride-vinyl acetate copolymer, polyester resin, urethane resin and so on. The primer layer is formed by the method such as gravure coat, gravure reverse coat, roll coat and knife coat. The primer layer, in the dry condition, may have the thickness of 0.1 [$\mu$ m] to 5 [$\mu$ m]. Further, curing agent (or hardener) may be incorporated into the primer layer or self-bridging may be done with respect to the material of the primer layer, so that the membrane strength can be improved.

The aforementioned thermal transfer image-receiving sheet 20 and the thermal transfer film 10 (or 30) are temporary (peelably) bonded such that the receptor layer 22 and the heat-fusible ink layer 13 are attached to each other, as shown in FIGS. 1 and 2. Namely, the receptor layer 22 and the heat-fusible ink layer 13 are peelably bonded by the adhesive of receptor layer 22.

The adhesive strength of the receptor layer 22 of the thermal transfer image-receiving sheet 20 and the heat-fusible ink layer 13 of the thermal transfer film 10 (or 30), is preferably in the range of 300 [g] to 2000 [g] in the measurement condition mentioned below. Namely, the composite thermal transfer sheet 100 (or 200) of the present invention is cut into the piece whose size of 22 [mm] (width) ×55 [m] (length), and thus a sample of the composite thermal transfer sheet is prepared for the measurement. The adhesive strength with respect to the sample, which is measured by using a surface friction measuring device (HEIDEN-17, made by SINTOHKAGAKU) in a condition that the speed of testing rate of stressing (elastic stress rate or rate of straining elapsed time) is 1800 [mm/min], is preferably in the range of 300 to 2000 [g]. If the adhesive strength is less than 300 [g], the adhesive strength between the thermal transfer film 10 (or 30) and the thermal transfer image-receiving sheet 20 is so weak that both are easily peeled and wrinkles are formed in the thermal transfer film 10 (or 30). If the adhesive strength is more than 2000 [g], the adhesive strength is enough, but the heat-fusible ink layer 13 is easily transferred to the thermal transfer image-receiving sheet 20 in a blank thereof, and background pollution is easily occurred in the thermal transfer image-receiving sheet 20.

The thermal transfer film 10 (or 30) and the thermal transfer image-receiving sheet 20 are bonded by the method explained below. Namely, the receptor layer 22 and the heat-fusible ink layer 13 are superposed and continuously bonded to each other by the adhesive of the receptor layer 22, and these are rolled. In such a case, the thermal transfer image-receiving sheet 20 may be disposed at the outside of the roll, but the thermal transfer film 10 (or 30) may be disposed at the outside. On the other hand, the thermal transfer film 10 (or 30) and the thermal transfer image-receiving sheet 20 may be bonded by another method, wherein the thermal transfer film 10 (or 30) and the thermal transfer image-receiving sheet 20 are cut into cut-sheets, then both are superposed and bonded to each other.

EXPERIMENTAL EXAMPLE 1

The embodiments of the present invention is specifically described with reference to EXPERIMENTAL EXAMPLES 1, 2 and 3. In the description appearing below, "parts" and "%" are those by weight unless otherwise noted specifically.

Composition of Thermal Transfer Film

The base film of EXPERIMENTAL EXAMPLE 1 is composed of polyethylene terephthalate having the thickness of 4.5 [$\mu$ m], and the back side layer is formed on the back side surface thereof. Then, the coating liquid for forming the mat layer is coated on the surface of the base film (the opposite side of the back side surface of the base film) in a condition that the amount of the coating liquid is 0.5 [g/m$^2$] based on the solid content thereof, and the coated base film is dried in the temperature of 80 [° C.] to 90 [° C.]. Therefore, the mat layer is formed on the surface of the base film. Further, the heat-fusible ink layer having the following composition is coated on the mat layer by the gravure coating in a condition that the amount of the ink composition is 3 [g/m$^2$], based on the solid content thereof, and the coated base film is dried in the temperature of 80 [° C.] to 90 [° C.]. Therefore, the heat-fusible ink layer is formed, and thus the thermal transfer film is formed.

| Coating Liquid for Mat Layer | |
|---|---|
| Polyester Resin (Bairon 200, made by Toyobou K.K.) | 16parts |
| Carbon black (Daiyaburakku, made by Mitubishikagaku K.K.) | 24parts |
| Dispersant | 1.5parts |
| curing agent | 3parts |
| methyl ethyl ketone/toluene (1/1) | 60parts |

| Ink Composition for Heat-Fusible Ink Layer | |
|---|---|
| Carbon Black (Daiyaburakku, made by Mitubishikagaku K.K.) | 13parts |
| Carnauba Wax | 9parts |
| Paraffin Wax (Melting Point: 69[°C.]) | 60parts |
| Ethylene-Vinyl Acetate Copolymer | 24parts |
| Microcrystalline Wax | 3parts |

Next, the aforementioned thermal transfer film and the thermal transfer image-receiving sheet formed by a method explained below are prepared, and the heat-fusible ink layer of the thermal transfer film and the receptor layer of the thermal transfer image-receiving sheet are temporary (peelably) bonded to each other. Therefore, the thermal transfer sheet of EXPERIMENTAL EXAMPLE 1 according to the present invention is obtained. The bonding is carried out in a condition that the nip temperature is 50 [° C.] and the nip pressure is 5 [kg/c m$^2$].

Composition of Thermal Transfer Image-Rceiving Material

The coated paper (as a substrate) having basis weight of 84.9 [g/m$^2$] is prepared, and the receptor layer having the following composition is coated on the coated paper by the gravure coater, in a condition that the amount of the composition is 1.0 [g/m$^2$] based on the solid content thereof. Then, the coated paper, on which the composition of the receptor layer is coated, is dried in the temperature of 50 [° C.] to 120 [° C.], and thus the receptor layer is formed on the coated paper. Therefore, the thermal transfer image-receiving sheet is formed.

| Composition for Receptor Layer | |
|---|---|
| Styrene-Butadiene Rubber (Tg = 0[°C.]) | 28 parts |
| Pigment Yellow 12 | 40 parts |
| Calcium Carbonate (Average Particle Diameter 0.3 [$\mu$m]) | 23 parts |
| Dispersant | 9 parts |

EXPERIMENTAL EXAMPLE 2

The composite thermal transfer sheet of EXPERIMENTAL EXAMPLE 2 is formed in the similar condition to EXPERIMENTAL EXAMPLE 1 except for the composition of the receptor layer. Namely, the receptor layer of EXPERIMENTAL EXAMPLE 2 has the following composition.

| Composition for Receptor Layer | |
|---|---|
| Acrylic Resin (Tg = 15[°C.]) | 28 parts |
| Pigment Yellow 12 | 27 parts |
| Calcium Carbonate (Average Particle Diameter 0.3 [μm]) | 16 parts |
| Carnauba Wax | 22 parts |
| Dispersant | 7 parts |

EXPERIMENTAL EXAMPLE 3

The composite thermal transfer sheet of EXPERIMENTAL EXAMPLE 3 is formed in the similar condition to EXPERIMENTAL EXAMPLE 1, except that the anti-pollution layer is coated on the heat-fusible ink layer of the thermal transfer film. Namely, the anti-pollution layer having the following composition is coated by the photogravure in a condition that the amount thereof is 0.3 [g/m$^2$], based on the solid content thereof. Then, the coated thermal transfer film is dried in the temperature of 80 [° C.] to 90 [° C]. Therefore, the anti-pollution layer is formed.

| Composition for Anti-pollution layer | |
|---|---|
| Carnauba Wax Emulsion (Melting Point: 83[°C.], average particle diameter 0.6 [μm]) | (Single Component) |

COMPARATIVE SAMPLE 1

The thermal transfer film of the thermal transfer sheet of COMPARATIVE SAMPLE 1 has a temporary adhesive layer. Namely, the temporary adhesive layer is formed on the heat-fusible ink layer of the thermal transfer film used in EXPERIMENTAL EXAMPLE 1. More concretely, the temporary adhesive layer having the following composition is coated by the photogravure in condition that the amount of the composition is 0.3 [g/m$^2$], based on the solid content thereof. Then the coated thermal transfer film is dried in temperature of 80 [° C.] to 90 [° C.], and thus the temporary adhesive layer is formed.

On the other hand, in the thermal transfer image-receiving sheet used for COMPARATIVE SAMPLE 1, a coated paper having basis weight of 84.9 [g/m$^2$] is used as the substrate, and the receptor layer is not formed on the coated paper.

Next, the aforementioned thermal transfer film and the thermal transfer image-receiving sheet are temporary bonded to each other. Namely, the temporary adhesive layer of the thermal transfer film and the surface of thermal transfer image-receiving sheet, i.e. the surface of the coated paper, are superposed and temporary bonded to each other. Therefore, the composite thermal transfer sheet of COMPARATIVE SAMPLE 1 is formed. In addition, the bonding condition is the same as EXPERIMENTAL EXAMPLE 1.

| Composition for Temporary Adhesive Layer | |
|---|---|
| Carnauba Wax Emulsion | 67 parts |
| Acrylic Resin | 33 parts |

COMPARATIVE SAMPLE 2

The thermal transfer sheet of COMPARATIVE SAMPLE 2 is formed in the similar condition to COMPARATIVE SAMPLE 1, except that the heat-fusible ink layer of the thermal transfer film includes polyethylene wax (melting point: 80 [° C.]) instead of paraffin wax (melting point: 69 [° C.]).

COMPARATIVE SAMPLE 3

The thermal transfer sheet of COMPARATIVE SAMPLE 3 is formed in the similar condition to EXPERIMENTAL EXAMPLE 1, except that the receptor layer of the thermal transfer image-receiving sheet consist of styrene-butadiene latex (Tg=0 [C.]) only.

EVALUATION

The printing sensitivity and the presevability of the composite thermal transfer sheet prepared in each of EXPERIMENTAL EXAMPLES 1 to 3 and COMPARATIVE SAMPLES 1 to 3, is evaluated in the following method and condition. Namely, at first, each of the aforementioned composite thermal transfer sheet is set into a facsimile printer. Next, heat, whose energy is 0.1 mj/dot, is supplied to a thermal head of the facsimile printer, and printing is carried out under a condition of 25 [° C.] and 50 [%RH]. Then, the thermal transfer image-receiving sheet is peeled from the thermal transfer film, and the desired image is formed on the thermal transfer image-receiving sheet. Thereafter, the evaluation is done as followings.

Printing Sensitivity

Under a condition of 25 [° C.], 50 [%RH], the energy of 0.1 mj/dot is supplied to the thermal head of the facsimile printer, and printing is carried out, and then the desired image is formed on each of the thermal transfer image-receiving sheet. Then, the quality of the printing is evaluated on the basis of the visual observation, and the printing sensitivity is evaluated.

The result of the evaluation is shown in TABLE 1 by using the following symbols ○ and ×.

○: The transfer condition is good and the printing sensitivity is also good.

×: The transfer condition is bad and the printing sensitivity is also bad.

Preservability

A couple of the composite thermal transfer sheets explained in each of EXPERIMENTAL EXAMPLES 1 to 3 and COMPARATIVE SAMPLES 1 to 3, are prepared. One of the couple in each example or sample is preserved for a month in a condition that it have been rolled, under a preserving condition of 45 [° C.] and 85 [%RH]. The other is preserved for a month in a condition that it have been rolled, under a preserving condition of 55 [° C.] and 85 [%RH]. Thereafter, with respect to each of the couples of the composite thermal transfer sheets, the printing is carried out in the same printing condition of the printing sensitivity evaluation, as mentioned above. Then, background pollution on the receptor layer of the thermal transfer image-receiving sheet is evaluated on the basis of the visual observation.

The result of the evaluation is shown in TABLE 1 by using the following symbols ○ and ×.

○: There is not any background pollution on the receptor layer.

Δ: There is a little background pollution thereon. ×: There is much background pollution thereon.

TABLE 1

| | Printing | Preservability | |
|---|---|---|---|
| | Sensitivity | 40[°C.] 85% | 55[°C.] 85% |
| EXPERIMENTAL EXAMPLE 1 | ○ | ○ | Δ |
| EXPERIMENTAL EXAMPLE 2 | ○ | ○ | ○ |
| EXPERIMENTAL EXAMPLE 3 | ○ | ○ | ○ |
| COMPARATIVE SAMPLE 1 | ○ | Δ | x |
| COMPARATIVE SAMPLE 2 | x | ○ | Δ |
| COMPARATIVE SAMPLE 3 | x | x | —*1 |

*1: The surface of the printed matter is sticky.

In the TABLE 1, it is recognized that each of the examples is better than each of the samples in view of the printing sensitivity and the preservaility.

According to the aforementioned embodiments of the present invention, the receptor layer 22 is formed on the substrate 21 of the thermal transfer image-receiving sheet 20, and the adhesive property is added to the receptor layer 22. Therefore, the thermal transfer film 10 (or 30) and the thermal transfer image-receiving sheet 20 can be peelably bonded to each other by the adhesive property of the receptor layer 22.

Especially, since a glass transition temperature Tg of thermoplastic resin in receptor layer 22 is in the range of −50 [° C.] to 30 [° C.], the suitable adhesive property for peelably bonding the thermal transfer film 10 (or 30) and thermal transfer image-receiving sheet 20 is obtained in the receptor layer 22 of the thermal transfer image-receiving sheet 20.

Further, since the adhesive property is added to the receptor layer 22 of the thermal transfer image-receiving sheet 20, it is prevented that an ink of the heat-fusible ink layer 13 of the thermal transfer film 10 (or 30) is easily transferred to the thermal transfer image-receiving sheet 20 when the composite thermal transfer sheet 100 (or 200) is preserved for a long period, or preserved in a condition of high temperature. Thus, background pollution can be prevented.

Furthermore, the filler of the receptor layer 22 adjusts the adhesive property and prevents the heat energy supplied to the thermal transfer film 10 (or 30) from passing through the thermal transfer image-receiving sheet 20 to the side of the substrate 21. Thus, the printing sensitivity can be improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A composite thermal transfer sheet comprising:

a thermal transfer film comprising a base film and a heat-fusible ink layer formed on the base film; and a thermal transfer image-receiving sheet comprising a substrate and a receptor layer formed on the substrate, the receptor layer comprising a thermoplastic resin, which has an adhesive property, and an inorganic and/or organic filler, the receptor layer and the heat-fusible ink layer being peelably bonded to each other by the adhesive property of the thermoplastic resin in the receptor layer, so that the thermal transfer film and the thermal transfer image-receiving sheet are peelably bonded to each other.

2. A composite thermal transfer sheet according to claim 1, wherein a glass transition temperature Tg of the thermoplastic resin in the receptor layer is in a range of −50° C. to 30° C.

3. A composite thermal transfer sheet according to claim 1, wherein, in the receptor layer, a ratio of the thermoplastic resin and the filler is 1:(0.5 to 10).

4. A composite thermal transfer sheet according to claim 1, wherein a glass transition temperature Tg of the filler in the receptor layer is not less than 50° C.

5. A composite thermal transfer sheet according to claim 1, wherein the receptor layer further comprises a wax having not more than 30 percentage by weight.

6. A composite thermal transfer sheet according to claim 1, wherein the thermal transfer film further comprises a mat layer between the base film and the heat-fusible ink layer.

7. A composite thermal transfer sheet according to claim 1, wherein the thermal transfer film further comprises a back side layer formed on a back side surface of the base film.

8. A composite thermal transfer sheet according to claim 1, wherein the thermal transfer film further comprises at least one anti-pollution layer formed on the heat-fusible ink layer, and the anti-pollution layer comprises transparent components.

9. A composite thermal transfer sheet according to claim 8, wherein the anti-pollution layer comprises a wax whose melting point is more than that of the heat-fusible ink layer.

10. A composite thermal transfer sheet according to claim 1, wherein the receptor layer is colored.

11. A thermal transfer image-receiving sheet used for a composite thermal transfer sheet comprising a thermal transfer film and the thermal transfer image-receiving sheet peelably bonded to each other, comprising:

a substrate; and a receptor layer formed on the substrate, the receptor layer comprising a thermoplastic resin, which has an adhesive property, and an inorganic and/or organic filler, the thermal transfer film and the thermal transfer image-receiving sheet being peelably bonded to each other through the receptor layer by the adhesive property of the thermoplastic resin in the receptor layer.

12. A thermal transfer image-receiving sheet according to claim 11, wherein a glass transition temperature Tg of the thermoplastic resin in the receptor layer is in a range of −50° C. to 30° C.

13. A thermal transfer image-receiving sheet according to claim 11, wherein, in the receptor layer, a ratio of the thermoplastic resin and the filler is 1:(0.5 to 10).

14. A thermal transfer image-receiving sheet according to claim 11, wherein a glass transition temperature Tg of the filler in the receptor layer is not less than 50° C.

15. A thermal transfer image-receiving sheet according to claim 11, wherein the receptor layer further comprises a wax having not more than 30 percentage by weight.

* * * * *